US005900841A

United States Patent [19]

Hirata et al.

[11] Patent Number: 5,900,841

[45] Date of Patent: May 4, 1999

[54] ANTENNA DEVICE HAVING AN ANTENNA PROPER AND A PLASTIC PLATE ATTACHED TO THE ANTENNA PROPER FOR CONNECTING THE ANTENNA TO AN INSIDE WALL OF A VEHICLE

[75] Inventors: Tomio Hirata, Fuji; Takehiko Yamazaki, Kawasaki, both of Japan

[73] Assignees: Nihon Plast Co., Ltd, Fuji; Nissan Motor Co., Ltd, Yokohama, both of Japan

[21] Appl. No.: 08/756,521

[22] Filed: Nov. 26, 1996

[30] Foreign Application Priority Data

Nov. 30, 1995 [JP] Japan ..... 7-313298

[51] Int. Cl.[6] ..... H01Q 1/32

[52] U.S. Cl. ..... 343/713; 343/712

[58] Field of Search ..... 343/713, 873, 343/895, 700 MS, 711, 712; 126/343.5

[56] References Cited

U.S. PATENT DOCUMENTS

| | | | |
|---|---|---|---|
| 3,638,225 | 1/1972 | Zawoniak | 343/713 |
| 3,816,837 | 6/1974 | Smith | 343/713 |
| 4,086,595 | 4/1978 | Cherenco et al. | 343/713 |
| 4,757,322 | 7/1988 | Yokoyawa et al. | 343/713 |
| 4,811,024 | 3/1989 | Ohe et al. | 343/713 |
| 5,220,336 | 6/1993 | Hirotsu et al. | 343/713 |
| 5,596,335 | 1/1997 | Dishart et al. | 343/713 |

FOREIGN PATENT DOCUMENTS

| | | | |
|---|---|---|---|
| 2405561 | 6/1979 | France | 343/713 |
| 0030102 | 2/1986 | Japan | 343/713 |
| 7-58535 | 3/1995 | Japan . | |

*Primary Examiner*—Don Wong
*Assistant Examiner*—Tan Ho
*Attorney, Agent, or Firm*—Foley & Lardner

[57] ABSTRACT

An antenna device for use in a motor vehicle comprises a plastic plate which is attached to an inside wall of a given part of the vehicle; and an antenna proper which includes a plastic film and an electrically conductive antenna pattern printed on the plastic film. The antenna proper is interposed between the plastic plate and the inside wall in such a manner that the printed antenna pattern is interposed between the plastic film and the plastic plate.

20 Claims, 12 Drawing Sheets

ANTENNA DEVICE HAVING AN ANTENNA PROPER AND A PLASTIC PLATE ATTACHED TO THE ANTENNA PROPER FOR CONNECTING THE ANTENNA TO AN INSIDE WALL OF A VEHICLE

BACKGROUND OF THE INVENTION (1) Field of the Invention

The present invention relates in general to antennas of motor vehicles and more particularly to automotive antenna devices of a type fixed to an interior part of the vehicle.

(2) Description of the Prior Art

In some of the latest motor vehicles, a so-called "keyless entry system" is employed which can lock and unlock the doors with usage of a wireless remote controller. In such system, an antenna is mounted to the vehicle for receiving the instruction radio wave signal from the remote controller. Usually, the antennas are of a type which is attached to an interior part of the vehicle. One of such antennas is an antenna which is printed on a rear window pane of the vehicle by using a printing process. However, for production of such type antenna, to protect the antenna, an additional printing process is further needed for covering the printed antenna with a carbon layer or the like, which inevitably causes increase in production cost of the vehicle. The other one of such antennas is an antenna device disclosed in Japanese Patent First Provisional Publication 7-58535. In this case, the antenna device is incorporated with a pillar garnish of a vehicle. That is, the antenna proper is intimately interposed between a pillar of the vehicle and an ornamental plastic plate fixed to the pillar. However, also this type of automotive antenna device has drawbacks. That is, the production process of the device is complicated and thus the cost of the same increases. Furthermore, the pillar having the antenna connected thereto becomes bulky in construction.

SUMMARY OF THE INVENTION

It is therefore an object of the present invention to provide an automotive antenna device which is free of the drawbacks possessed by the above-mentioned conventional antennas.

According to the present invention, there is provided an antenna device for use in a motor vehicle, which comprises a plastic plate attached to an inside wall of a given part of the vehicle; and an antenna proper including a plastic film and an electrically conductive antenna pattern printed on the plastic film, the antenna proper being interposed between the plastic plate and the inside wall in such a manner that the printed antenna pattern is interposed between the plastic film and the plastic plate.

BRIEF DESCRIPTION OF THE DRAWINGS

Other objects and advantages of the present invention will become apparent from the following description when taken in conjunction with the accompanying drawings, in which.

DETAILED DESCRIPTION OF THE INVENTION

In the following, the present invention will be described in detail with reference to the attached drawings. For ease of description, substantially same parts and constructions are designated by the same numerals throughout the specification and drawings.

Figure 2:
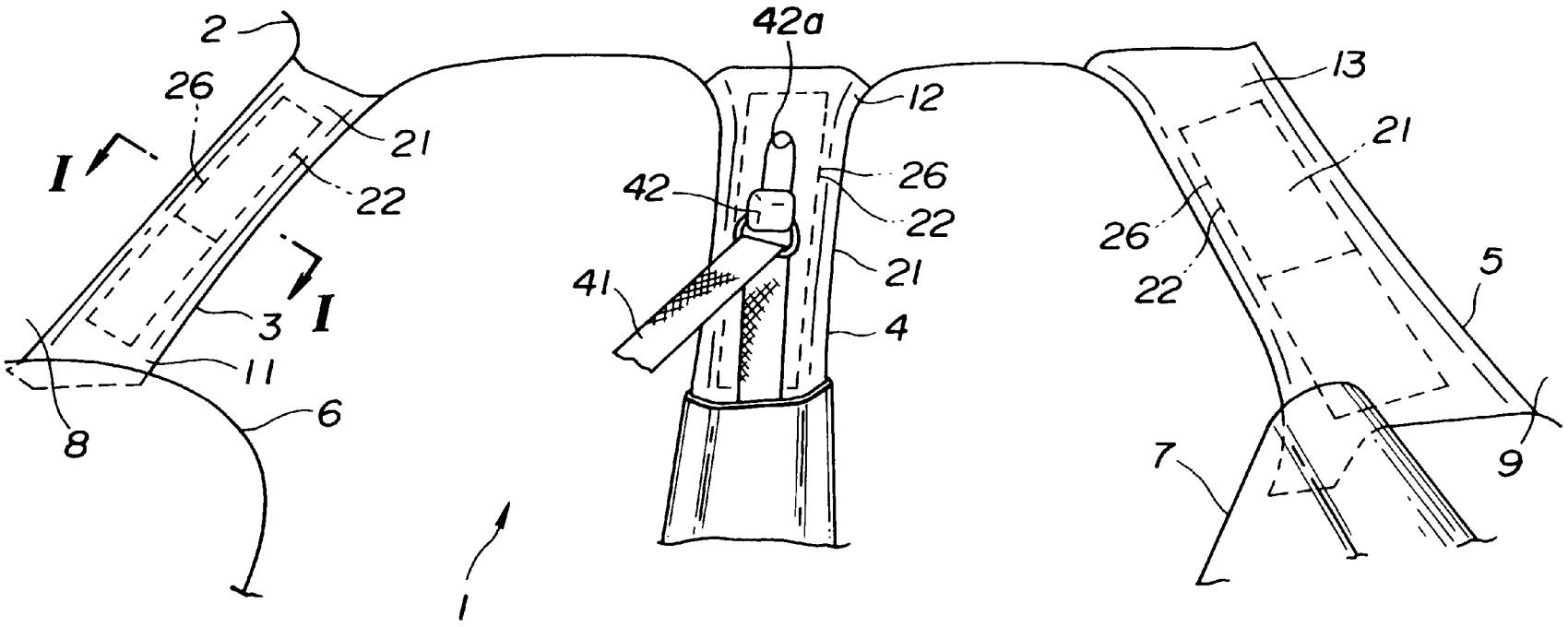
FIG. 2 is a schematically illustrated interior view of the motor vehicle, showing front, center and rear pillars of the vehicle.

In FIG. 2, there is shown a passenger cabin 1 of a motor vehicle to which an antenna device of the present invention is practically applied. In the drawing, designated by numeral 2 is a roof of the vehicle, which is supported by two front pillars 3 (only one is shown), two center pillars 4 (only one is shown) and two rear pillars 5 (only one is shown). Designated by numeral 6 is an instrument panel which is arranged at a front part of the vehicle cabin. A windshield 8 extends laterally between the two front pillars 3. Designated by numeral 7 is a rear seat which is arranged at a rear part of the vehicle cabin. A rear window pane 9 extends laterally between the two rear pillars 5. The front and center pillars 3 and 4 define therebetween a front door opening with which a front side door (not shown) is incorporated, and the center and rear pillars 4 and 5 define therebetween a rear door opening with which a rear side door (not shown) is incorporated.

To inside walls of these three pillars 3, 4 and 5, there are fixed front, center and rear garnishes 11, 12 and 13 respectively. As will become apparent as the description proceeds, each garnish 11, 12 or 13 has an antenna device fixed to an outside surface thereof.

Since the antenna devices attached to the front, center and rear pillars 3, 4 and 5 are substantially the same in construction, detailed description on the antenna devices will be directed to only the antenna device attached to the front pillar 3 for simplification of the specification.

Figure 1:
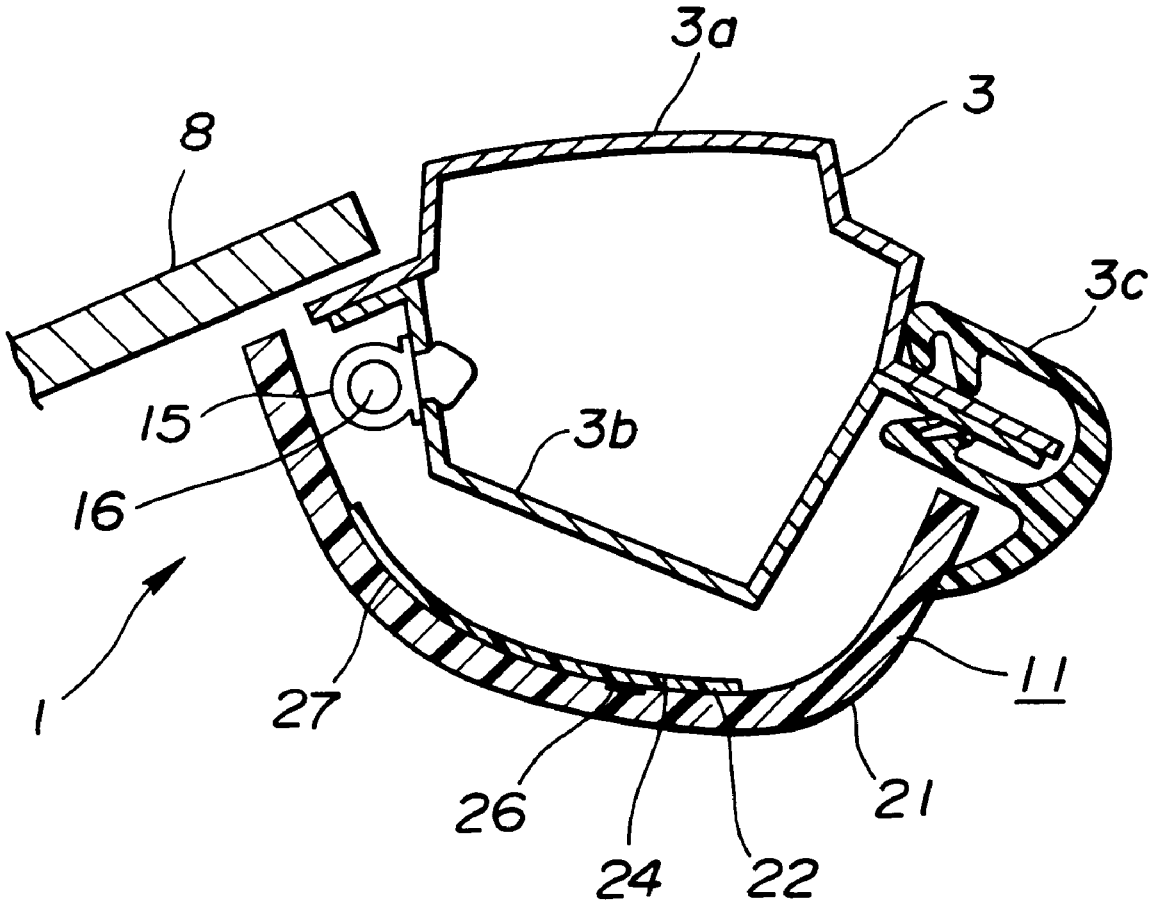
FIG. 1 is a sectional view of an antenna device of the present invention, which is incorporated with a front pillar of a motor vehicle the view being taken along the line I—I of FIG. 2.
Figure 3:
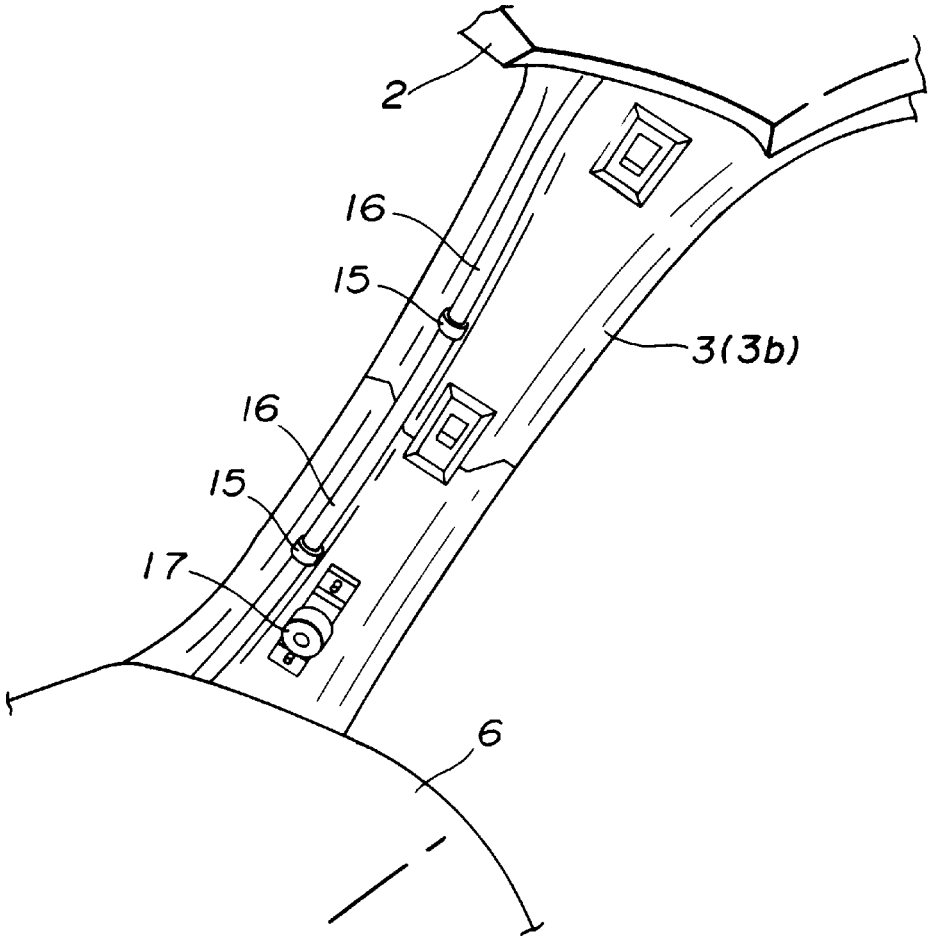
FIG. 3 is a view of the front pillar with a front garnish removed therefrom.

As is seen from FIG. 1, the front pillar 3 comprises outer and inner panels 3*a* and 3*b* which are coupled to constitute a vertically extending tubular structure. As is seen from FIGS. 1 and 3*a* cable holders 15 are connected to the inner panel 3*b* for holding vertically extending electric cables 16. As is seen from FIG. 3, a speaker 17 is mounted to a lower portion of the inner panel 3*b*.

Figure 4:
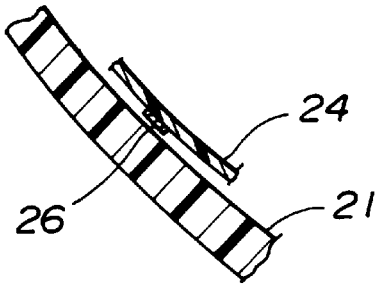
FIG. 4 is a sectional view of the front garnish and an antenna proper attached thereto.

As is understood from FIGS. 1, 2 and 4, the front garnish 11 comprises a plastic ornamental plate 21 connected to the front pillar 3 leaving a certain clearance therebetween. As is seen from FIG. 1, the ornamental plate 21 is smoothly curved to conceal an inside wall of the front pillar 3 from the interior of the vehicle. Designated by numeral 3*c* is a weather strip through which a rear side edge of the ornamental plate 21 is sealed.

An antenna proper 22 is fixed via bonding to an outside surface of the ornamental plate 21. If is desired, an integral molding may be used for fixing the antenna proper 22 to the plastic ornamental plate 21.

Figure 5:
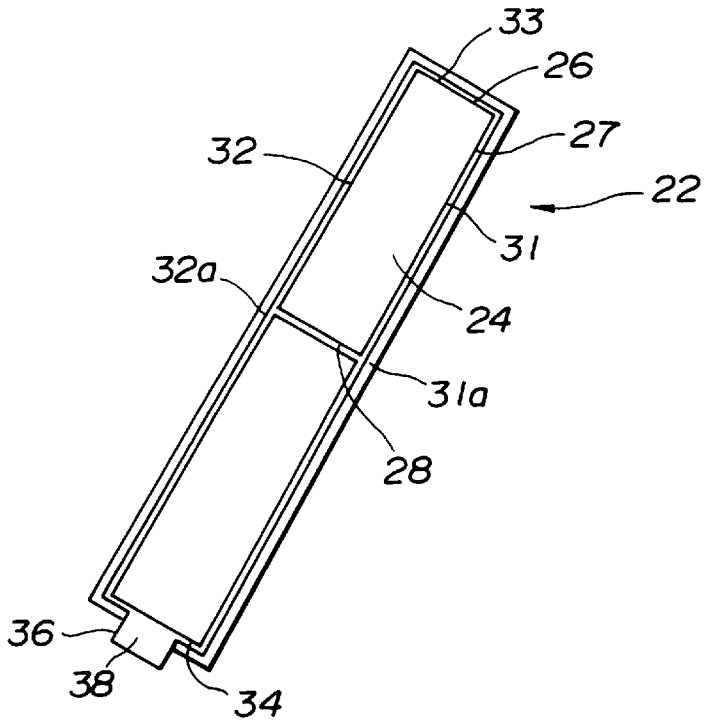
FIG. 5 is a plan view of an antenna proper of the antenna device of the invention.

As is seen from FIG. 5, the antenna proper 22 comprises an elongate plastic film 24 made of a polyester resin or the like, and an electrically conductive antenna pattern 26 printed on the film 24. The elongate plastic film 24 has at a lower end thereof a lug portion 36. The surface of the plastic film 24 on which the antenna pattern 26 is printed faces outside surface of the plastic ornamental plate 21. The material for the printed antenna pattern 26 is an electrically conductive ink which contains silver powder and carbon powder.

As is understood from FIG. 5, the printed antenna pattern 26 comprises a rectangular frame part 27 and a bridge part 28 which bridges over a center portion of the frame part 27, as shown. That is, the rectangular frame part 27 comprises two longer parallel side lines 31 and 32 and two shorter parallel side lines 33 and 34, and the bridge part 28 is a center line which connects a center portion 31*a* of the longer side line 31 and a center portion 32*a* of the other longer side line 32. The shorter side line 34 of the rectangular frame part 27 has a terminal portion 38 printed on the lug portion 36 of the elongate plastic film 24. Upon assembly, a cable (not shown) extending from a control unit mounted in the vehicle is connected via welding or the like to the terminal portion 38. More specifically, the cable has a connector which is fixed to the plastic ornamental plate 21 for achieving assured connection between the cable and the terminal portion of the antenna proper 22.

As is seen from FIG. 2, the antenna device attached to the center pillar 4 is incorporated with a seat belt holder 42 through which a seat belt 41 is slidably held. The seat belt holder 42 is connected through a connecting shaft to a vertically movable part of a base structure secured to the center pillar 4. The plastic ornamental plate 21 and the antenna proper 22 have vertically extending mated slots 42*a* through which the connecting shaft passes When, in operation, a wireless remote controller is operated near the vehicle, a radio wave instruction signal from the controller is caught by at least one of the six antenna devices respectively incorporated with the six pillars 3, 4 and 5 of the vehicle. Upon receiving such instruction signal, the control unit locks or unlocks the doors. Usually, the radio wave used in such a wireless remote control system has a frequency of 315 MHz and a power of 5 to 25 mW.

Figure 6:
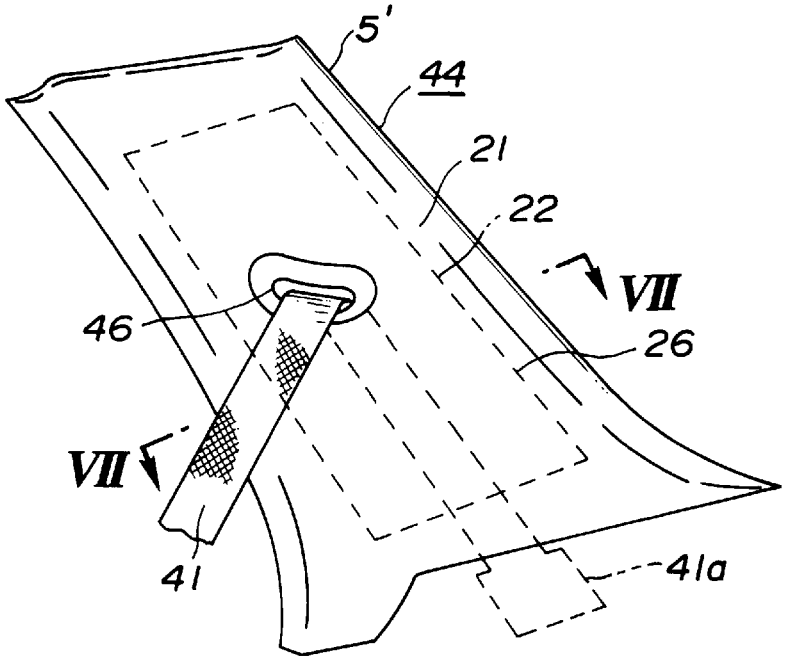
FIG. 6 is a view of another type rear pillar to which an antenna device of the invention is practically applied.
Figure 7:
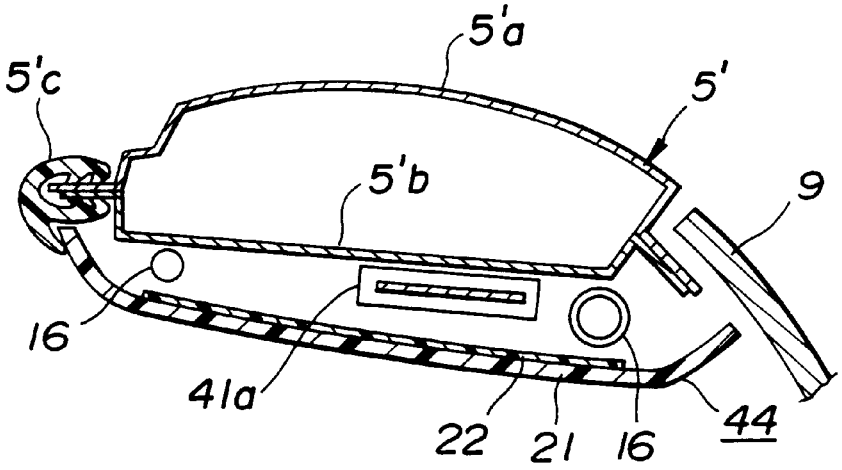
FIG. 7 is a sectional view taken along the line VII—VII of FIG. 6.

In FIGS. 6 and 7, there is shown another type rear pillar 5' to which an antenna device of the invention is practically applied. The rear pillar 5' has a rear seat bait 41 incorporated therewith.

As is understood from FIG. 7, the rear pillar 5' comprises outer and inner panels 5'a and 5'b which are coupled to constitute a vertically extending tubular structures Designated by numeral 44 is a rear garnish which comprises a plastic ornamental plate 21 connected to the rear pillar 5' leaving a certain clearance therebetween. Designated by numeral 5'c is a weather strip through which a front side edge of the ornamental plate 21 is sealed. Electric cables 16 extend vertically through the clearance between the rear pillar 5' and the plastic ornamental plate 21. An antenna proper 22 is attached to a rear surface of the ornamental plate 21 in such a manner as has been described hereinabove.

As is understood from FIGS. 6 and 7, an emergency lock type seat belt retractor 4'a is installed in a lower position of the clearance between the rear pillar 5' and the antenna-installed rear garnish 44, from which the seat belt 41 extends upward. The rear garnish 44 has a slot 46 through which the seat belt 41 is led to the interior of the vehicle.

Figure 8:
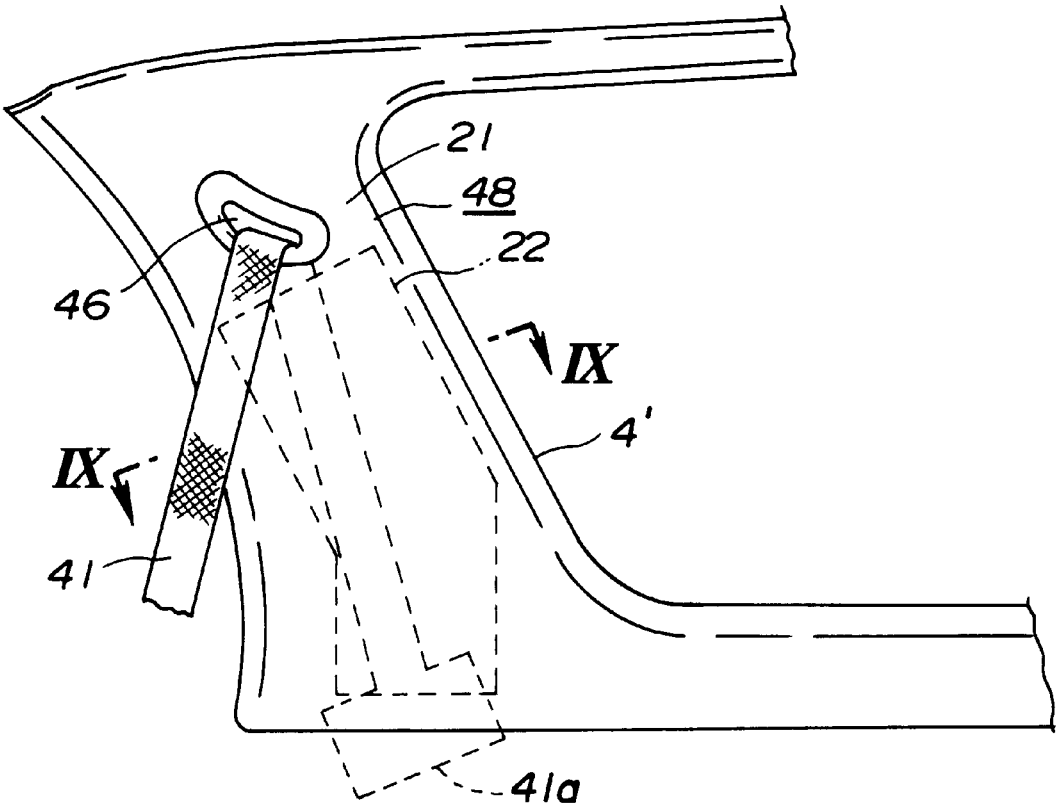
FIG. 8 is a view of another type center pillar to which an antenna device of the invention is practically applied.
Figure 9:
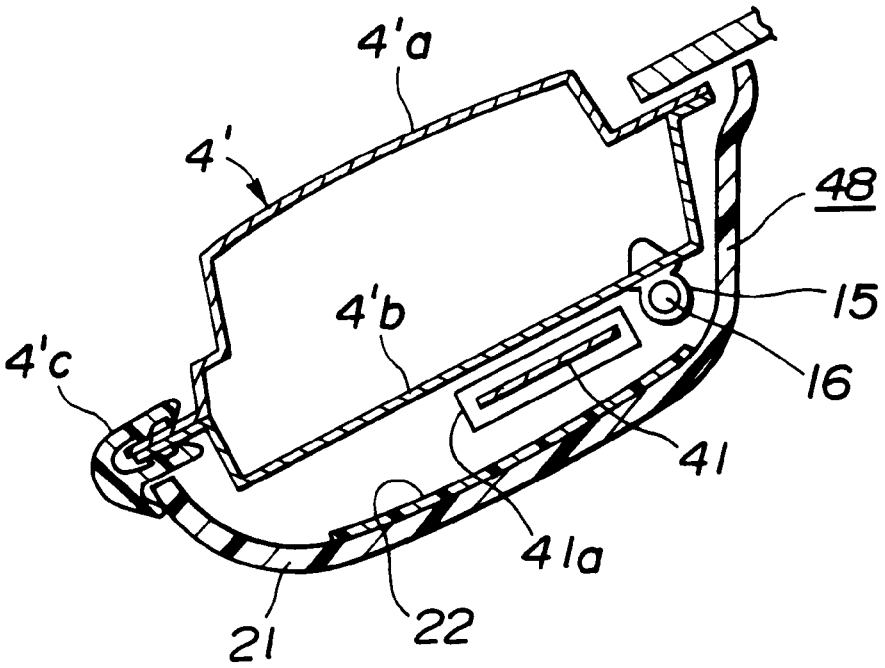
FIG. 9 is a sectional view taken along the line IX—IX of FIG. 8.
Figure 10:
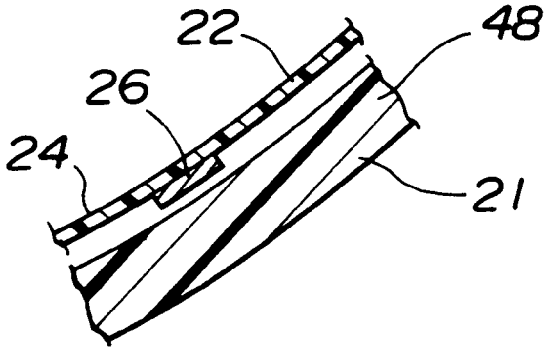
FIG. 10 is a sectional view of the center garnish and the antenna device which are incorporated with the center pillar of FIG. 8.
Figure 11:
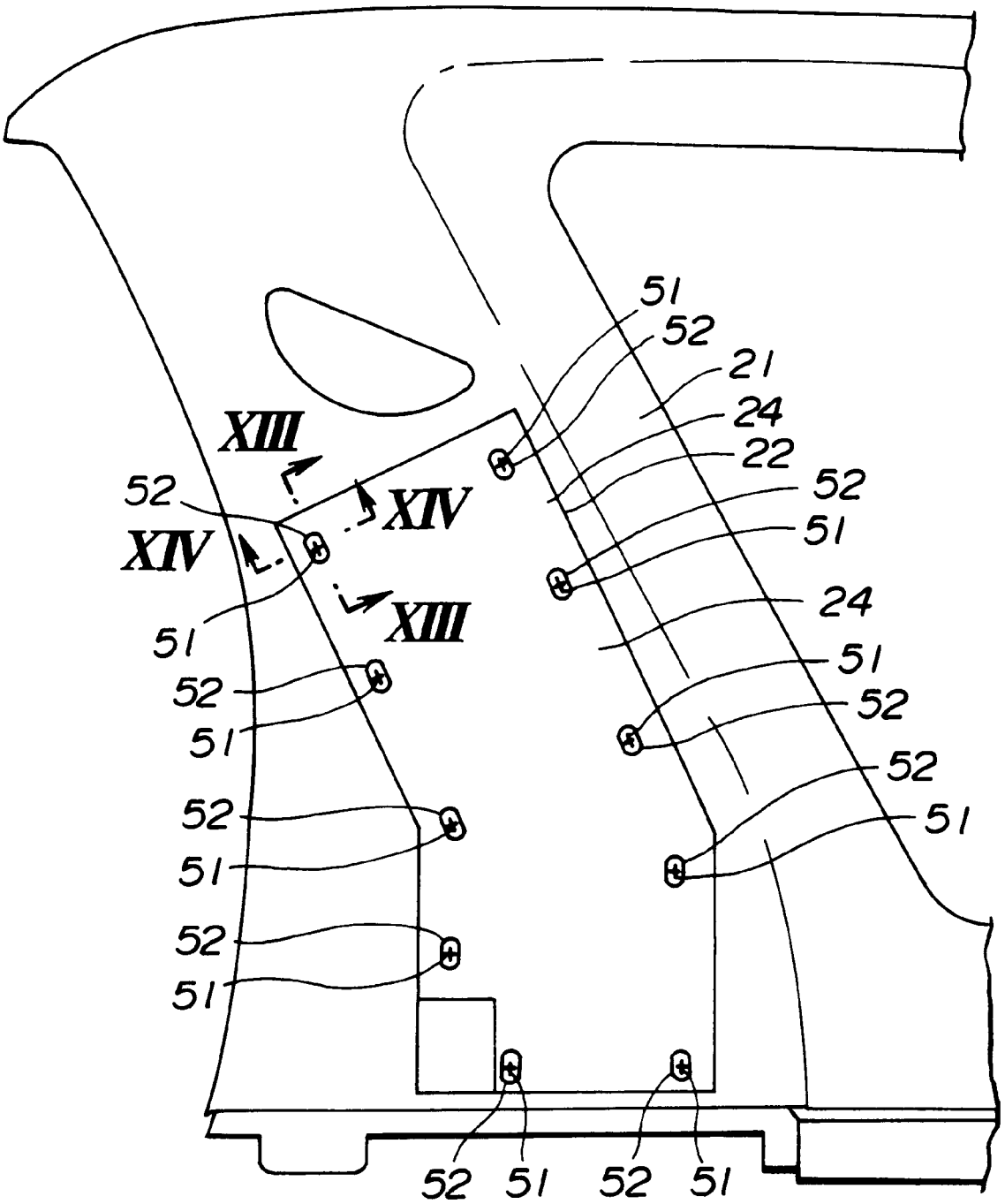
FIGS. 11, 12, 13A, 13B, 14A and 14B are views for depicting the method of fixing an antenna proper to a plastic ornamental plate.

In FIGS. 8 to 10, there is shown another type center pillar 4' to which an antenna device of the invention is practically applied. The center pillar 4' has a seat belt 41 incorporated therewith.

As is understood from FIG. 9, the center pillar 4' comprises outer and inner panels 4'a and 4'b which are coupled to constitute a vertically extending tubular structure. Designated by numeral 48 is a center garnish which comprises a plastic ornamental plate 21 connected to the rear pillar 4' leaving a certain clearance therebetween. Designated by numeral 4'c is a weather strip through which a front side edge of the ornamental plate 21 is sealed. An electric cable 16 extending through the clearance is connected to the center pillar 4' through cable holders 15 secured to the center pillar 4'. An antenna proper 22 is attached to an outside surface of the plastic ornamental plate 21 in such a manner as has been described hereinabove. The antenna proper 22 has a lower portion somewhat bent.

As is understood from FIGS. 8 and 9, an emergency lock type seat belt retractor 41*a* is installed in a lower position of the clearance between center pillar 4' and the antenna-installed center garnish 48 from which the seat belt 41 extends upward. The center garnish 48 has a slot 46 through which the seat belt 41 is led to the interior of the vehicle.

As has been described hereinabove, in the present invention, the antenna proper 22 is attached to an outside surface of a garnish 11, 12, 13, 44 or 48 which is fixed to a pillar 3 4, 5, 5' or 4' leaving a certain clearance therebetween. The antenna proper 22 comprises an elongate plastic film 24 and an electrically conductive antenna pattern 26 printed on the film 24. Upon assembly, the antenna proper 22 is attached to the outside surface of the garnish having the printed antenna pattern 26 intimately disposed therebetween. This means that the printed antenna pattern 26 is protected by the film 24 Thus, even when some parts such as electric cables 16, cable holders 15 and speaker 17 are brought into contact with the antenna proper 22 during their assembling process, the sensitive printed antenna pattern 26 is prevented from being damaged.

Referring to FIGS. 11 to 14, there is depicted a method of fixing the antenna proper 22 to the outside surface of the plastic ornamental plate 21 (or corresponding garnish). For this attachment, as is seen from FIGS. 11, 12 and 13A, the plastic ornamental plate 21 is formed with a plurality of cross stubs 51, and the antenna proper 22 is formed with a plurality of oval openings 52. As is seen from FIGS. 12, 13A and 14A, the cross stubs 51 are put into the oval openings 52 and as is seen from FIGS. 13B and 14B, the projected portions of the cross stubs 51 are heated and thus melted to form enlarged heads 51*a*. With these enlarged heads 51*a*, the antenna proper 22 is attached to the ornamental plate 21.

Figure 12:
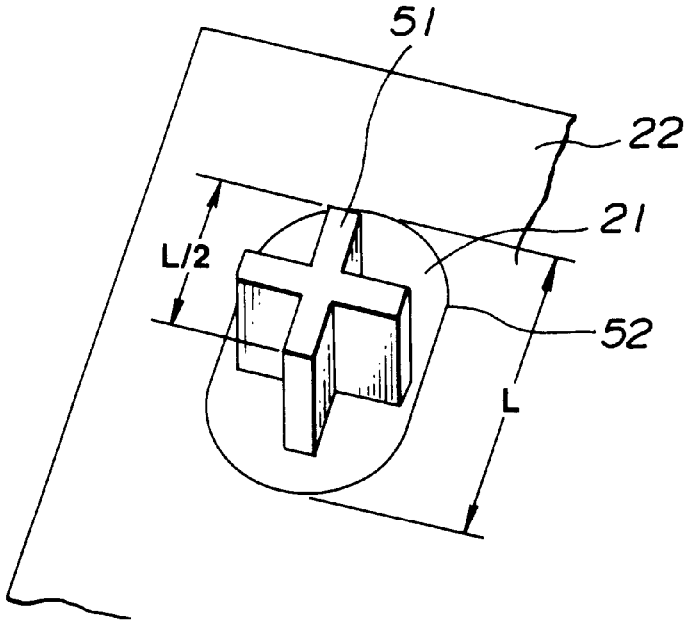
Figure 13A:
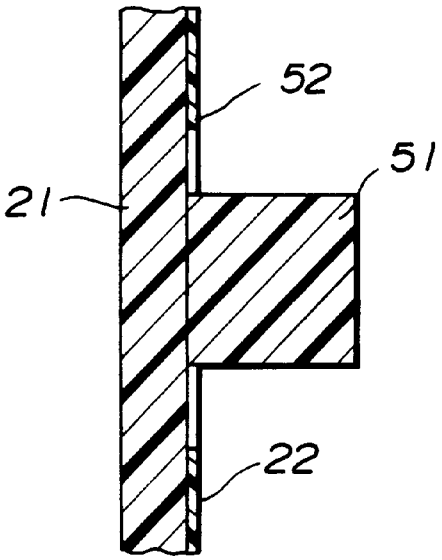
Figure 13B:
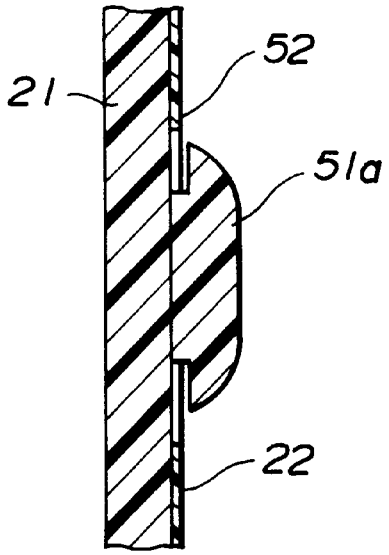
Figure 14A:
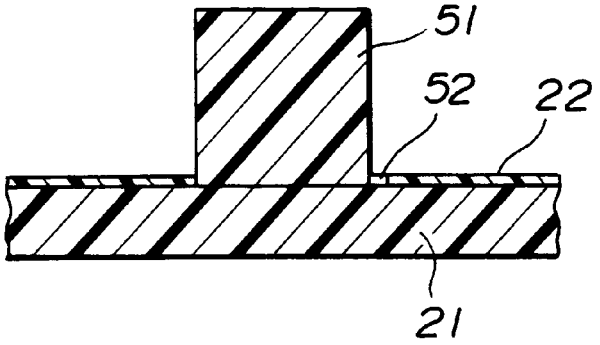
Figure 14B:
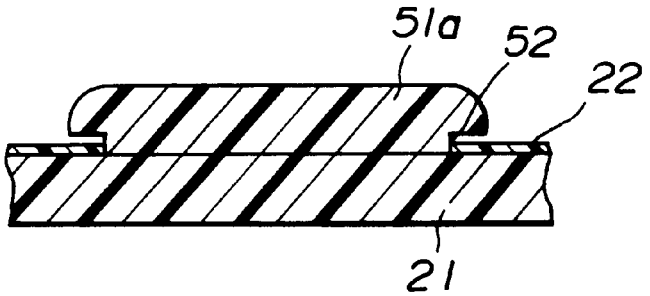

As is seen from FIG. 12, the minor axis of each oval opening 52 is slightly larger than the lateral length of the corresponding cross stub 51, and the major axis of the oval opening 52 is about twice as long as the longitudinal length of the cross stub 51. Thus, when the cross stubs 51 are put into the oval openings 52, the antenna proper 22 is permitted to make a certain displacement relative to the ornamental plate 21. This is very advantageous when the passenger room of the vehicle is subjected to a marked temperature change. That is, even when subjected to a thermal expansion or contraction due to the temperature change in the passenger room, the antenna proper 22 is prevented from being stressed by the cross stubs 51. If the antenna proper 22 would be stressed and thus deformed by the cross stubs 51, the wave collecting performance of the antenna pattern 26 is lowered. More, specifically, if, in summer, the antenna pattern 22 would sag by a certain degree due to a high temperature in the passenger room, the size of the antenna pattern 26 is increased and thus the tuning sensitivity is shifted to a lower frequency side. Preferably, the material of the plastic film 24 is selected from materials which have a melting point higher than that of the ornamental plate 21 by 20° C. and over.

Figure 15:
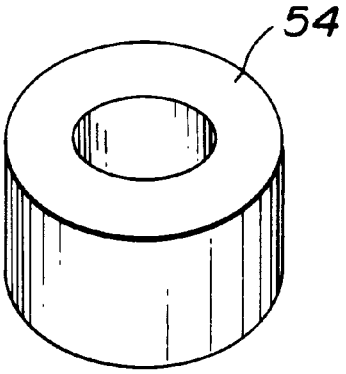
FIG. 15 is a perspective view of a modified stub formed on the plastic ornamental plate.

As is seen from FIG. 15, if desired, the stubs on the ornamental plate 21 may have a cylindrical structure which is denoted by numeral 54.

In order to find out the ideal shape of the antenna pattern 26 printed on the film 24, various tests have been carried out by the inventors.

Figure 16:
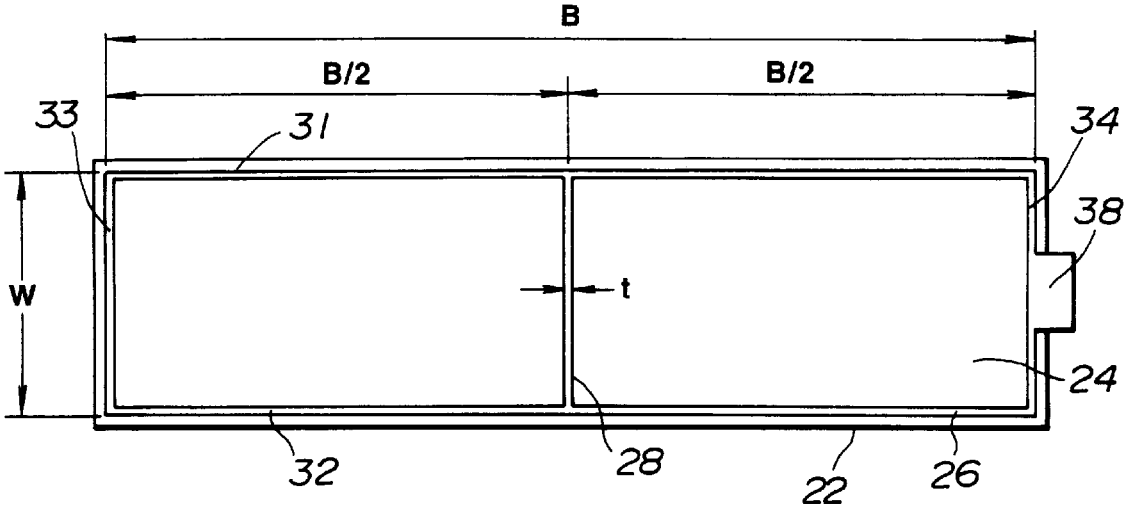
FIG. 16 is a plan view of an antenna pattern employed in the antenna device of the invention.

In the tests, a plurality of test pieces were produced, one of which is shown in FIG. 16. In this drawing, reference "B" denotes the length of the longer side lines 31 and 32 of the antenna pattern 26, and reference "W" denotes the length of the shorter side lines 33 and 34 of the same. Reference "t" denotes the width of the line of the antenna pattern 26.

The plastic ornamental plate 21 used was a plate of polypropylene (PP), the plastic film 24 was a film of polyethylene terephthalate (PET) having 0.125 mm in thickness. The conductive ink for the antenna pattern 26 was a pasty ink provided by mixing 50% silver powder and 50% carbon powder in an volatile organic solvent. The width "t" of the line of the printed antenna pattern 26 was 1 mm.

TABLE-1 shows the result of the tests, that is, appropriate dimensional ratio between the length "B" of the lower side lines 31 and 32 and the length "W" of the shorter side lines 33 and 34 with respect to the wave length "λ" of a radio wave signal used.

TABLE 1

| B | λ/2 | λ/4 | λ/8 |
|---|---|---|---|
| W | λ/4, λ/8, λ/16, λ/32 | λ/8, λ/16, λ/32 | λ/16, λ/32 |

According to the tests, it has been revealed that the appropriate dimensional ratio can have a permissible variation of about 80% to about 120% in accordance with the material of the ink and the width "t" of the line of the antenna pattern 26.

For example, in case of using a radio wave signal of 315 MHz (whose wave length "λ" is 952 mm), the ideal shape of the antenna pattern 26 is looked up with reference to the TABLE-1 and the space where the pattern 26 is to be installed. That is, if the space has the length "B" of the longer side lines 31 and 32 sufficient for "λ/4", the length "W" of the shorter side lines 33 and 34 can be selected from the group including "λ/16" and "λ/32". Thus, if "λ/4" and "λ/16" are selected, the lengths "B" and "W" become 238 mm and 119 mm, respectively. Due to the above-mentioned permissible variation, the length "B" can range from 190 mm to 285 mm and the length "W" can range from 95 mm to 142 mm.

As is described hereinabove, by suitably selecting the ratio between the lengths "B" and "W" from the TABLE-1, desired printed antenna patterns 26 for various motor vehicle (more specifically, for various garnishes) are easily determined.

Figure 17:
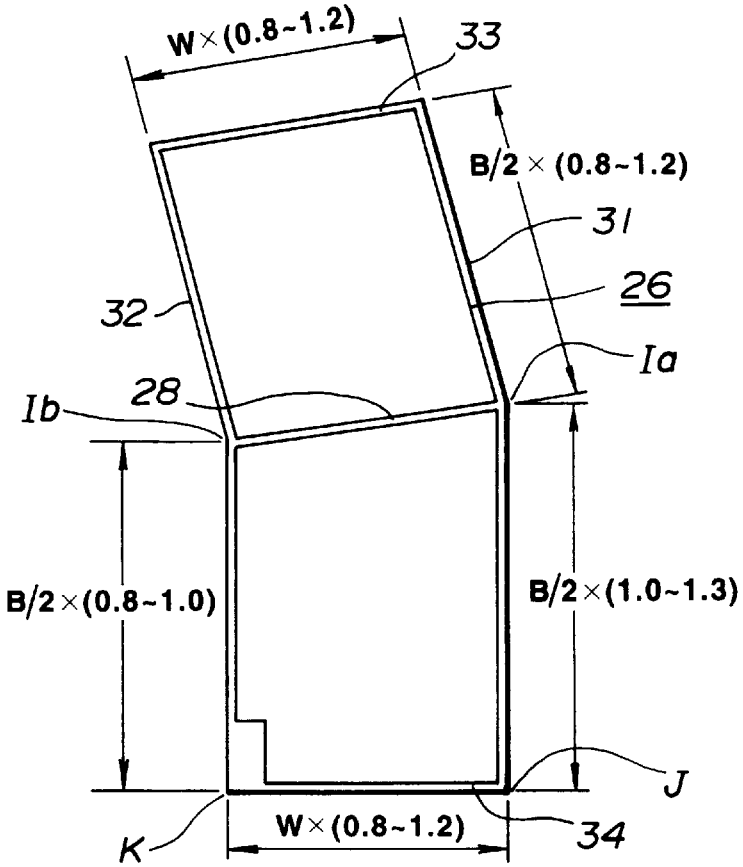
FIG. 17 is a view similar to FIG. 16, but showing a first modification of the antenna pattern.

In FIG. 17, there is shown an ideal shape of the antenna pattern 26 in a case wherein the same is needed to be bent at a middle portion. As shown in the drawing, a first bending point "Ia" appears on the right longer side line 31 at position separated from the lower end "J" of the line 31 by a distance of "B/2×(1.0 to 1.3)", while a second bending point "Ib" appears on the left longer snide line 32 at a position separated from the lower end "K" of the line 32 by a distance of "B/2×(0.8 to 1.0)". These two bending points "Ia" and "Ib" are connected through the bridge part 28.

Figure 18:
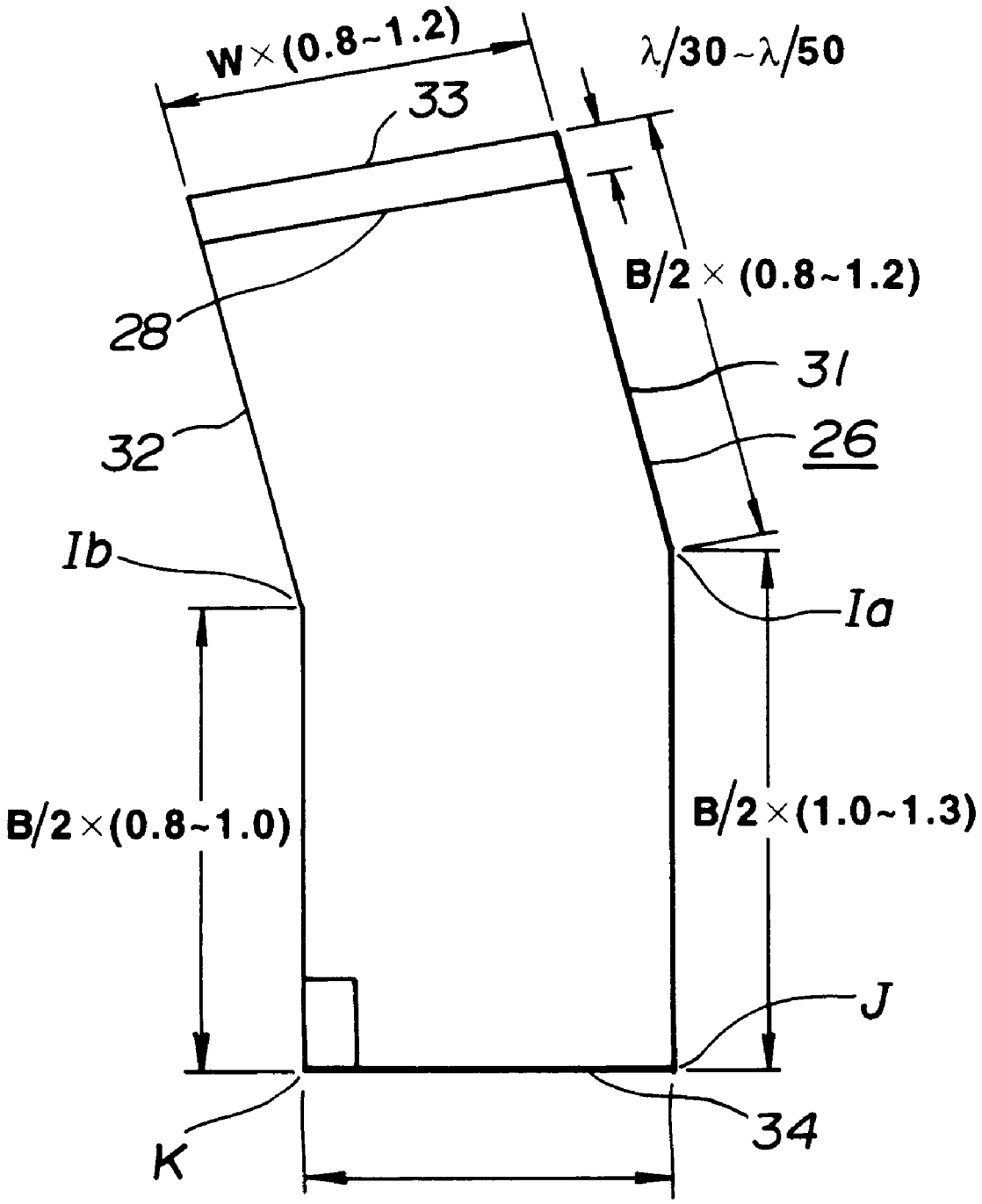
FIG. 18 is a view similar to FIG. 17, but showing a second modification of the antenna pattern.
Figure 19:
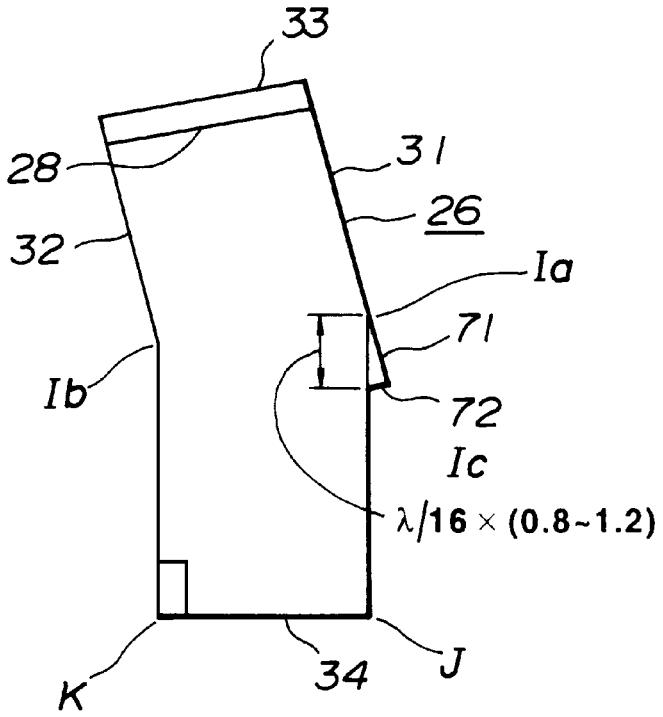
FIG. 19 is a view similar to FIG. 18, but showing a third modification of the antenna pattern.
Figure 20:
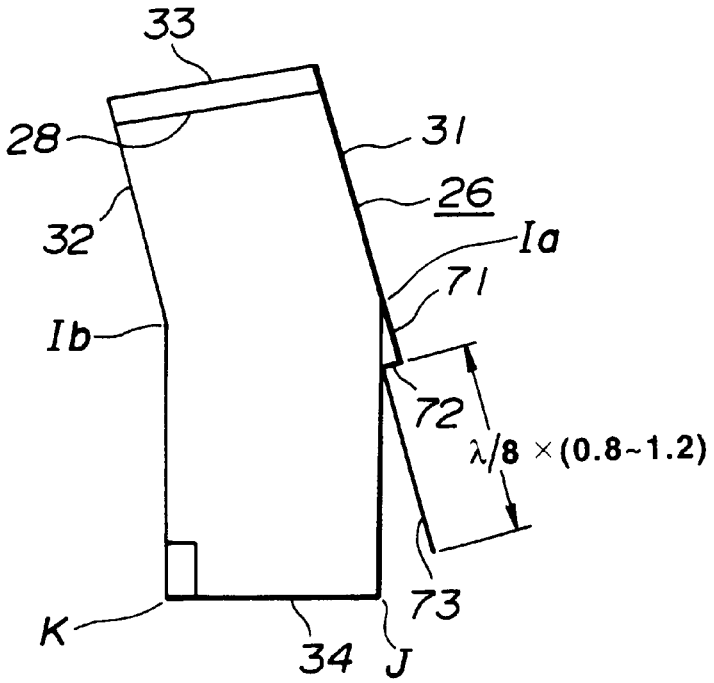
FIG. 20 is a view similar to FIG. 19, but showing a fourth modification of the antenna pattern.

In FIGS. 18, 19 and 20, there are shown other ideal shapes of the antenna pattern 26 when the same is needed to be bent. When employing these shapes, the directivity of the antenna device is improved.

The antenna pattern 25 of FIG. 18 is a modification of the antenna pattern of FIG. 17.

That is, in the antenna pattern 26 of FIG. 18, the bridge part 28 is positioned near the upper shorter line 33. More specifically, the bridge part 28 extends in parallel with the upper shorter line 33 and while separating from the same by a distance of "λ/30 to λ/50".

The antenna pattern 26 of FIG. 19 is a modification of the antenna pattern 26 of FIG. 18.

That is, in the antenna pattern 26 of FIG. 19, a first extra line 71 and a second extra line 72 are further employed in the antenna pattern 26 of FIG. 18. The first extra line 71 extends downward from the first bending point "Ia" in aligned with the upper part of the right longer side line 31, and the second extra line 72 extends from a leading end of the first extra line 71 in parallel with the bridge part 28. The first and second extra lines 71 and 72 are so sized and arranged that the second extra line 72 intersects the lower part of the line 31 at a point "Ic" which is separated from the first bending point "Ia" by a distance of "λ/16×(0.8 to 1.2)".

The antenna pattern 26 of FIG. 20 is a modification of the antenna pattern 26 of FIG. 19.

That is, in the antenna pattern 26 of FIG. 20, a third extra line 73 is further employed in the antenna pattern 26 of FIG. 19. That is, the third extra line 73 extends downward from the point "Ic" in parallel with the first extra line 71 by a length of "λ/8×(0.8 to 1.2)".

What is claimed is:

1. An antenna device for use in a motor vehicle, comprising:

a plastic plate connected to an inside wall of a given part of the motor vehicle in such a manner so as to leave a given clearance between said plastic plate and said inside wall; and an antenna proper including a plastic film and an electrically conductive antenna pattern printed on said plastic film, said antenna proper being attached to said plastic plate having said printed antenna pattern interposed therebetween and having said plastic film spaced away from said inside wall.

2. An antenna device as claimed in claim 1, in which said given part is a pillar which constitutes a part of a body of the motor vehicle.

3. An antenna device as claimed in claim 1, in which said plastic film and said plastic plate are united by melting parts of said plastic plate.

4. An antenna device as claimed in claim 3, in which said antenna pattern is integrally formed with a terminal portion printed on said plastic film.

5. An antenna device as claimed in claim 1, in which said antenna pattern comprises:

a rectangular frame part including first and second mutually opposed longer lines and first and second mutually opposed shorter lines which are combined to constitute a rectangular shape; and a bridge part connecting the first and second longer lines, wherein each of said first and second longer lines has a length corresponding to ½, ¼ or ⅛ of the wave length of a given radio wave received by said antenna device, wherein when the length of each of the first and second longer lines is ½ of said wave length, each of said first and second shorter lines has a length corresponding to ¼, ⅛, 1/16 or 1/32 of said wave length, wherein when the length of each of the first and second longer lines is ¼ of said wave length, each of said first and second shorter lines has a length corresponding to ⅛, 1/16 or 1/32 of said wave length, and wherein when the length of each of the first and second longer lines is ⅛ of said wave length, each of said first and second shorter lines has a length corresponding to 1/16 or 1/32 of said wave length.

6. An antenna device as claimed in claim 5, in which the length of each of said first and second longer lines has a permissible variation of about 80% to about 120%.

7. An antenna device as claimed in claim 6, in which said permissible variation varies in accordance with the material of the printed antenna pattern and the size of each line.

8. An antenna device as claimed in claim 1, wherein said plastic plate is a garnish connected to said inside wall to conceal said inside wall with the given clearance left therebetween, and wherein the antenna pattern of said antenna proper is intimately attached to an outside surface of said garnish.

9. An antenna device as claimed in claim 8, wherein the given clearance defined between said garnish and said inside wall is so sized as to receive a part of a seatbelt.

10. An antenna device as claimed in claim 8, wherein the given clearance defined between said garnish and said inside wall is so sized as to receive an electric cable which extends substantially vertically.

11. An antenna device as claimed in claim 1, wherein said plastic film of said antenna proper is formed with a plurality of openings into which a plurality of projections formed on said plastic plate are fitted to achieve a coupling between said antenna proper and said plastic plate.

12. An antenna device for use in a motor vehicle, comprising:

a plastic plate attached to an inside wall of a given part of said vehicle; and an antenna proper including a plastic film and an electrically conductive antenna pattern printed on said plastic film, said antenna proper being interposed between said plastic plate and said inside wall in such a manner that said printed antenna pattern is interposed between said plastic film and said plastic plate, wherein said plastic film and said plastic plate are united by melting parts of said plastic plate, and wherein said parts of said plastic plate are melted projections which have passed through openings formed in said plastic film.

13. An antenna device as claimed in claim 12, in which said plastic film has a melting point higher than that of said plastic plate by 20° C. and over.

14. An antenna device as claimed in claim 12, in which said openings of said plastic film are oval in shape so that the plastic film is permitted to move relative to said plastic plate before the melting process is carried out.

15. An antenna device for use in a motor vehicle, comprising:

a plastic plate attached to an inside wall of a given part of said vehicle; and an antenna proper including a plastic film and an electrically conductive antenna pattern printed on said plastic film, said antenna proper being interposed between said plastic plate and said inside wall in such a manner that said printed antenna pattern is interposed between said plastic film and said plastic plate, wherein said antenna pattern comprises:

a rectangular frame part including first and second mutually opposed longer lines and first and second mutually opposed shorter lines which are combined to constitute a rectangular shape; and a bridge part connecting the first and second longer lines, wherein each of said first and second longer lines has a length corresponding to ½, ¼ or ⅛ of the wave length of a given radio wave received by said antenna device, wherein when the length of each of the first and second longer lines is ½ of said wave length, each of said first and second shorter lines has a length corresponding to ¼, ⅛, 1/16 or 1/32 of said wave length, wherein when the length of each of the first and second longer lines is ¼ of said wave length, each of said first and second shorter lines has a length corresponding to ⅛, 1/16 or 1/32 of said wave length, wherein when the length of each of the first and second longer lines is ⅛ of said wave length, each of said first and second shorter lines has a length corresponding to 1/16 or 1/32 of said wave length, wherein the length of each of said first and second longer lines has a permissible variation of about 80% to about 120%, and wherein said first and second longer lines have first and second bending points respectively, so that the entire of the antenna pattern is bent at a generally middle portion.

16. An antenna device as claimed in claim 15, in which said first bending point is separated from one end of said first longer line by a distance of "B/2×(1.0 to 1.3)", and in which said second being point is separated from one end of said second longer line by a distance of "B/2×(0.8 to 1.0)", said "B" being the length of each of the first and second longer lines.

17. An antenna device as claimed in claim 16, in which said bridge part connects said first and second bending parts.

18. An antenna device as claimed in claim 16, in which said bridge part extends in parallel with said first shorter line while separating from the same by a distance of 1/30 to 1/50 of the wave length.

19. An antenna device as claimed in claim 18, further comprising:

a first extra line extending from said first bending point in alignment with one part of said first longer line; and a second extra line extending from a leading end of said first extra line in parallel with said bridge part, wherein said first and second extra lines are so sized and arranged that the second extra line intersects the first longer line at a given point which is separated from said first bending point by a distance of "$\lambda/16\times(0.8$ to $1.2)$", said "$\lambda$" being the wave length.

20. An antenna device as claimed in claim 19, further comprising a third extra line which extends from said given point in parallel with said first extra line by a length of "$\lambda/8\times(0.8$ to $1.2)$".

* * * * *